US009845992B2

(12) United States Patent
Kokourine et al.

(10) Patent No.: US 9,845,992 B2
(45) Date of Patent: Dec. 19, 2017

(54) FEED FLOW CONDITIONER FOR PARTICULATE FEED MATERIALS

(71) Applicant: Hatch LTD, Mississauga (CA)

(72) Inventors: Alex Kokourine, Mississauga (CA); Maciej Jastrzebski, Mississauga (CA); Kamal Adham, Mississauga (CA)

(73) Assignee: HATCH, LTD., Mississauga (CA)

( * ) Notice: Subject to any disclaimer, the term of this patent is extended or adjusted under 35 U.S.C. 154(b) by 83 days.

(21) Appl. No.: 14/899,312

(22) PCT Filed: Jun. 16, 2014

(86) PCT No.: PCT/CA2014/050560

§ 371 (c)(1),
(2) Date: Dec. 17, 2015

(87) PCT Pub. No.: WO2014/201556

PCT Pub. Date: Dec. 24, 2014

(65) Prior Publication Data

US 2016/0138867 A1 May 19, 2016

Related U.S. Application Data

(60) Provisional application No. 61/835,716, filed on Jun. 17, 2013.

(51) Int. Cl.
*F27D 3/00* (2006.01)
*F23K 3/00* (2006.01)
(Continued)

(52) U.S. Cl.
CPC ..... *F27D 3/0033* (2013.01); *F23K 3/00* (2013.01); *F27D 3/18* (2013.01); *F27D 19/00* (2013.01);
(Continued)

(58) Field of Classification Search
CPC ..... F27D 3/0033; F27D 3/16
(Continued)

(56) References Cited

U.S. PATENT DOCUMENTS 3,277,582 A 10/1966 Munro et al.
3,720,351 A 3/1973 Coulter et al.
(Continued)

FOREIGN PATENT DOCUMENTS

CN 2730827 Y 10/2005
CN 201520551 7/2010
(Continued)

OTHER PUBLICATIONS

Suenaga et al., "High-Performing Flash Smelting Furnace at Saganoseki Smelter & Refinery", Second International Conference on Processing Materials for Properties, The Minerals, Metals & Materials Society, 2000, pp. 879-884.
(Continued)

*Primary Examiner* — Scott Kastler
(74) *Attorney, Agent, or Firm* — John M. DeBoer; Rao DeBoer Osterrieder, PLLC

(57) ABSTRACT

A feed charging device comprises a holding vessel having an interior chamber for holding a reserve of a solid particulate feed material in a fluidized state, wherein the feed material is held in said fluidized state in a lower zone of the interior chamber. The feed material is supplied to the interior chamber through at least one outlet opening, and is discharged from the interior chamber through at least one outlet opening. The at least one outlet opening is in flow communication with the lower zone of the interior chamber. A gas supply means supplies a fluidizing gas to the lower zone of the interior chamber, and an outlet conduit in flow communication with the at least one outlet opening receives said feed material discharged from the interior chamber.

32 Claims, 10 Drawing Sheets

(51) Int. Cl.

| | |
|---|---|
| ***F27D 3/18*** | (2006.01) |
| ***F27D 19/00*** | (2006.01) |
| ***F27D 99/00*** | (2010.01) |
| *F27D 3/16* | (2006.01) |

(52) U.S. Cl.
CPC ..... *F27D 99/0033* (2013.01); *F27D 3/16* (2013.01); *F27D 2003/0006* (2013.01); *F27D 2003/161* (2013.01); *F27D 2003/167* (2013.01)

(58) Field of Classification Search
USPC ..... 266/172
See application file for complete search history.

(56) References Cited

U.S. PATENT DOCUMENTS

| | | | | |
|---|---|---|---|---|
| 3,804,303 | A | 4/1974 | Fassauer | |
| 3,881,702 | A | 5/1975 | McIver | |
| 3,981,417 | A | 9/1976 | Fassauer | |
| 4,172,667 | A | 10/1979 | Lenz et al. | |
| 4,182,383 | A | 1/1980 | Adomitis et al. | |
| 4,311,670 | A | 1/1982 | Nieminen et al. | |
| 4,326,702 | A | 4/1982 | Dueneau et al. | |
| 4,359,363 | A | 11/1982 | Durai-Swamy | |
| 4,377,466 | A * | 3/1983 | Wallman | C10B 49/20 201/31 |
| 4,406,410 | A | 9/1983 | Larson et al. | |
| 4,439,072 | A | 3/1984 | Goedken | |
| 4,744,311 | A | 5/1988 | Piekos | |
| 4,813,653 | A | 3/1989 | Piepers | |
| 4,820,494 | A | 4/1989 | Gartside et al. | |
| 4,934,876 | A | 6/1990 | Dirkse et al. | |
| 4,939,850 | A | 7/1990 | Baillie | |
| 5,096,096 | A | 3/1992 | Calaunan | |
| 5,106,240 | A | 4/1992 | Dirkse et al. | |
| 5,129,766 | A | 7/1992 | Dirkse et al. | |
| 6,238,457 | B1 | 5/2001 | Holmi et al. | |
| 6,241,801 | B1 * | 6/2001 | Kepplinger | C21B 13/002 266/172 |
| 6,565,799 | B1 | 5/2003 | Kojo et al. | |
| 6,764,296 | B2 | 7/2004 | Lahrah et al. | |
| 7,431,180 | B2 | 10/2008 | Bonerb | |
| 2004/0261671 | A1 | 12/2004 | Taylor | |
| 2009/0092465 | A1 | 4/2009 | Lonardi et al. | |
| 2009/0226284 | A1 | 9/2009 | Kojo | |
| 2010/0284768 | A1 | 11/2010 | Olin-nunez et al. | |
| 2011/0048317 | A1 | 3/2011 | Hunking et al. | |
| 2012/0068392 | A1 | 3/2012 | Thillen et al. | |
| 2012/0171054 | A1 | 7/2012 | Russell et al. | |
| 2013/0202369 | A1 | 8/2013 | Hamel et al. | |
| 2013/0320049 | A1 | 12/2013 | Shimono et al. | |
| 2016/0138867 | A1 * | 5/2016 | Kokourine | F23K 3/00 266/47 |

FOREIGN PATENT DOCUMENTS

| | | | |
|---|---|---|---|
| CN | 201583146 | U | 9/2010 |
| EP | 0348008 | B1 | 8/1992 |
| JP | 2004061104 | A | 2/2004 |
| JP | 2012171740 | A | 9/2012 |
| WO | 2011092165 | A1 | 8/2011 |
| WO | 2012115062 | A1 | 8/2012 |

OTHER PUBLICATIONS

Lamoureux et al., "Impact of Concentrate Feed Temporal Fluctuations on a Copper Flash Smelting Process", http://onlinelibrary.wiley.com/doi/10.1002/9781118887998.ch52/summary.
Supplemental European Search Report dated Jan. 24, 2017 for EP Application No. 14 81 3725 (8 pgs.).
Chinese Office Action dated Nov. 28, 2016 for for CN Application No. 201480034364.X (22 pgs.).

* cited by examiner

FEED FLOW CONDITIONER FOR PARTICULATE FEED MATERIALS

TECHNICAL FIELD

The present subject matter relates to fluidized feed bin systems for use with particulate feed materials. The system described herein could be applied in fields such as flash smelting, pharmaceuticals, or any other field where uniformity of feed flow in time, space and particle size distribution (PSD) is important.

BACKGROUND

There are numerous fields in which a particulate feed material must be uniformly distributed and introduced into a device, with respect to both time and space, while maintaining a well-mixed and steady particle size distribution within the feed stream.

A group of such applications concerns the delivery of particulate materials such as pulverized coal, dust or combustible ores to a combustion system, such as may be found in burners for heat generation, insufflation or smelting.

One such application that requires uniformity of feed flow is flash smelting for sulphide concentrates, such as may be encountered in the production of copper, nickel, lead or zinc. A flash smelting furnace typically includes an elevated reaction shaft at the top of which is positioned a burner or multiple burners where particulate feed material and reaction gas are brought together. In the case of copper smelting, the feed material is typically an ore concentrate containing both copper and iron sulfide minerals. The concentrate is usually mixed with a silica flux and combusted with preheated air or oxygen-enriched air. Molten droplets are formed in the reaction shaft and fall to the hearth, forming a copper-rich matte and an iron-rich slag layer.

A conventional burner for a flash smelter includes an injector having a water-cooled sleeve and an internal central lance, a windbox, and a cooling block that integrates with the roof of the furnace reaction shaft. The lower portion of the injector sleeve and the inner edge of the cooling block create an annular channel. Oxygen enriched combustion air enters the windbox and is discharged to the reaction shaft through this annular channel. The water-cooled sleeve and the internal lance of the injector also create an annular channel within the combustion air flow annulus. The feed material is introduced from above and descends through the injector sleeve into the reaction shaft through this internal annulus. Deflection of the feed material into the reaction gas is promoted by a bell-shaped tip at the lower end of the central lance. In addition, the tip includes multiple perforation jets that direct compressed air outwardly to disperse the feed material in an umbrella-shaped reaction zone. Such a burner for a flash smelting furnace is disclosed in U.S. Pat. No. 6,238,457.

The material feed supply equipment is typically comprised of bins and hoppers, mechanical feeders, conveyors, splitter boxes, manifold connectors, and feed pipes located above the injector. Typical feeders and conveyors include screw-feeders, table feeders, drag-chain conveyors and air slides. Some feed systems also combine feed streams of different particle density, shape, and size upstream of the burner.

Known feed systems of this type are associated with disadvantages that can adversely affect the burner performance and cause problems, such as: poor oxygen efficiency; variable furnace metallurgy and matte grade; increased copper losses to slag; increased elutriation of dust to the off-gas handling equipment, etc. These problems result from a failure to achieve uniformity of the feed material both spatially and in time on the appropriate scales, as well as causing segregation of the individual feed components with respect to particle size, density and/or shape.

For example, it is well documented that known mechanical feed systems, such as drag chains, screw conveyors and table feeders deliver the feed in discrete packets of material, resulting in low-frequency feed pulsations in the delivery of feed material to the burner, causing incomplete combustion. Such a system and the associated problem is described in Suenaga et al., "High-Performing Flash Smelting Furnace at Saganoseki Smelter & Refinery", Second International Conference on Processing Materials for Properties, The Minerals, Metals & Materials Society, 2000, pages 879-884.

It is also well documented that known feed systems suffer from periodic flow instabilities associated with uncontrollable partial fluidization of the charge in the feed bins. This normally occurs during the charging cycle of the bin, and results in uncontrolled delivery of feed material to the burner, typically lasting between one and several minutes. This has negative consequences on all aspects of the combustion process.

While air-slides and alternative bin designs have been proposed to address the above issues, these approaches suffer from serious drawbacks: Air-slides are incapable of eliminating low-frequency feed pulsations, serving instead to transmit them to the burner. Alternative bin designs, typically with a mass-flow hopper, can reduce the severity of the flushing phenomenon, but are typically large, or severely decrease the capacity of the bin for a given bin height or footprint. This makes retrofit of the alternative bins into existing feed systems costly and impractical.

Another example of a typical feed problem faced by concentrate burners is poor distribution of feed around the circumference of the burner. Feed systems usually contain one or more feed pipes that interface with the injector and attempt to utilize splitter boxes, guides and diverter chutes to distribute feed evenly around the circumference. Such systems tend to cause the feed to gather at corners/edges of the chute walls and fins, forming dense, "ropes" of feed within the plume. This lack of spatial uniformity results in poor ignition characteristics, non-uniformity of the combustion plume and reduced oxygen efficiency.

Pneumatic conveying systems have been proposed in an attempt to resolve both the pulsation problems, but these require a large investment of capital for new equipment, as well as substantial modifications to existing building layouts to accommodate the system. These systems do not, however, eliminate the problem of non-uniform circumferential distribution of the feed at the burner inlet, because they feed through intermediate, feed chutes, splitters or other equipment, and deliver the feed through discrete points around the circumference of the burner, necessarily leading to a lack of uniformity.

The process disturbances caused by temporally and spatially non-uniform delivery of the feed to flash smelting burners represent a significant loss of economic value to the flash smelter operator. None of the existing technologies adequately solves the problem of feed delivery. There thus remains a need for feed systems for flash smelting furnaces, or other applications using a particulate feed material, which provide uniform flow, both spatially and in time, around an inlet annulus with minimum particle segregation effects and in which the feed rate can be accurately controlled.

SUMMARY OF THE DISCLOSURE

The following summary is intended to introduce the reader to the more detailed description that follows, and not to define or limit the claimed subject matter.

In some examples, there is provided a feed charging device, comprising: (a) a holding vessel having an interior chamber for holding a reserve of a solid particulate feed material in a fluidized state, wherein the feed material is held in said fluidized state in a lower zone of the interior chamber; (b) at least one inlet opening through which the feed material is supplied to the interior chamber; (c) at least one outlet opening through which the feed material is discharged from the interior chamber, wherein said at least one outlet opening is in flow communication with the lower zone of the interior chamber; (d) gas supply means for supplying a fluidizing gas to the lower zone of the interior chamber; (e) an outlet conduit in flow communication with the at least one outlet opening for receiving said feed material discharged from the interior chamber.

In some examples, the feed charging device further comprises a bottom partition having a plurality of apertures, wherein the gas supply means comprises a gas distribution chamber which is separated from the interior chamber of the holding vessel by said bottom partition, wherein the gas distribution chamber has an inlet for receiving said fluidizing gas, and wherein an interior of the gas distribution chamber is in flow communication with the interior chamber of the holding vessel through the plurality of apertures in the bottom partition.

In some examples, the gas distribution chamber is enclosed within a windbox, and wherein the bottom partition forms a top wall of the windbox. The gas distribution chamber may comprise a plurality of compartments, each of said compartments being in flow communication with a portion of the interior chamber of the holding vessel through a subset of the plurality of apertures in the bottom partition.

In some examples, the feed charging device further comprises a baffle plate located inside the interior chamber in close proximity to the at least one inlet opening, wherein the baffle plate is mounted to the bottom partition to permit pneumatic elevation of the particulate feed material from bottom to top.

In some examples, the gas supply means is selected from the group consisting of tuyeres, porous pads and porous membranes. For example, the gas supply means may comprise a plurality of said tuyeres which are received in said bottom partition in spaced relation to one another, and wherein the apertures are defined by said tuyeres. Alternatively, the bottom partition may comprise one or more of said porous pads or porous membranes, and wherein the apertures are defined by said porous pads or porous membranes.

In some examples, the lower zone of the holding vessel defines an area to be occupied by a fluidized bed of said particulate feed material, and wherein the interior chamber also includes an upper zone which comprises a gas space above said fluidized bed. For example, the at least one inlet opening is provided in the lower zone of the interior chamber, and is located below a bed level of the fluidized bed to allow introduction of the particulate feed material into the fluidized bed below the bed level.

In some examples, the feed charging device further comprises at least one off-gas outlet opening provided in the interior chamber of the holding vessel, in communication with the upper zone of the interior chamber. For example, the feed charging device may further comprise at least one deflector plate, at least a portion of which is located in the upper zone of the interior chamber, between the at least one inlet opening of the holding vessel and the at least one off-gas outlet opening. The at least one deflector plate may be oriented substantially vertically and has a lower end which extends into the lower zone. The at least one deflector plate may be oriented substantially vertically and has a lower end which is spaced above the lower zone.

In some examples, the outlet conduit may pass through the lower and upper zones of the interior chamber, and wherein the at least one off-gas outlet opening is provided in a conduit wall of the outlet conduit.

In some examples, the outlet conduit has a conduit wall in which said at least one outlet opening is formed. For example, the outlet conduit may extend substantially vertically through said interior chamber, and wherein said gas supply means are radially dispersed around the outlet conduit. The at least one outlet opening may be arranged to receive said feed material from a plurality of radial directions. The conduit wall of the outlet conduit may have an outer perimeter, and wherein said at least one outlet opening is open to the lower zone of the interior chamber along substantially the entire outer perimeter of the conduit wall. For example, the at least one outlet opening may comprise a plurality of openings spaced apart along substantially the entire outer perimeter of the conduit wall; or the at least one outlet opening may comprise a horizontal slit extending throughout substantially the entire outer perimeter of the conduit wall.

In some examples, the at least one outlet opening is separated from a bottom of said interior chamber by a baffle ring having a height sufficient to prevent coarse particles within said particulate feed material from blocking said at least one outlet opening.

In some examples, an area of the at least one outlet opening is adjustable.

In some examples, the outlet conduit includes a slidable or rotatable cover member adapted to be moved steplessly or in discrete steps from a first position in which the area of the at least one outlet opening is at a maximum, to a second position in which the area of the at least one outlet opening is at a minimum.

In some examples, the feed charging device further comprises an actuation mechanism for controlling the movement of the cover member between said first position and said second position. For example, the at least one outlet opening may comprise a horizontal slit extending throughout substantially the entire outer perimeter of the conduit wall, and wherein the cover member comprises a sleeve which is slidable longitudinally along a surface of the outlet conduit between said first position and said second position, and wherein the horizontal slit has a greater height with the sleeve in the first position than in the second position.

In some examples, the feed charging device further comprises a plurality of sensors to measure a pressure drop of the particulate feed material in the interior chamber of the holding vessel.

In some examples, the feed charging device further comprises multiple actuated valves mounted externally of the holding vessel, a pressure sensor located in the lower zone and an electronic feedback controller for controlling the valves, so as to control a volumetric flow rate of the fluidizing gas into the interior chamber and maintain a required fluidization velocity using feedback from the pressure sensor, wherein the flow rate of the fluidizing gas is optionally used to control a discharge rate of the particulate feed material.

In some examples, the at least one outlet opening is provided in a side wall of the holding vessel.

In some examples, the side wall in which the at least one outlet opening is provided is distal to the at least one inlet opening. For example, the at least one outlet opening may be open to the lower zone of the interior chamber. The at least one outlet opening may comprise one or more openings located along a base of the side wall. The at least one outlet opening may comprise a horizontal slit extending along the base of the side wall. The at least one outlet opening may be spaced from a bottom of said interior chamber by a height sufficient to prevent coarse particles within said particulate feed material from blocking said at least one outlet opening. The area of the at least one outlet opening may be adjustable.

In some examples, the at least one outlet opening includes a slidable or rotatable cover member adapted to be moved steplessly or in discrete steps from a first position in which the area of the at least one outlet opening is at a maximum, to a second position in which the area of the at least one outlet opening is at a minimum. The feed charging device may further comprise an actuation mechanism for controlling the movement of the cover member between said first position and said second position. The at least one outlet opening may comprise a horizontal slit, and wherein the cover member comprises a valve member which is rotatable between said first position and said second position, and wherein the horizontal slit has a greater height with the sleeve in the first position than in the second position.

In some examples, an area of the at least one outlet opening is adjustable, and wherein the feed charging device further comprises: at least one sensor for measuring, directly or indirectly, a quantity of said particulate feed material inside the interior chamber; and means for controlling the area of the at least one outlet opening in response to changes in the quantity of said particulate feed material inside the interior chamber.

In some examples, said means for controlling the area of the at least one outlet opening comprises a slidable or rotatable cover member adapted to be moved steplessly or in discrete steps from a first position in which the area of the at least one outlet opening is at a maximum, to a second position in which the area of the at least one outlet opening is at a minimum.

In some examples, said means for controlling the area of the at least one outlet opening further comprises an actuation mechanism for controlling the movement of the cover member between said first position and said second position.

In some examples, the feed charging device is for a flash smelting furnace including an elevated reaction shaft having a burner, and wherein the outlet conduit is attached to the upper end of the burner, above a reaction shaft where the particulate feed material is reacted with a reaction gas.

In some examples, there is provided method for improving the combustion performance of a flash smelting concentrate burner by improving the spatial and temporal uniformity of the feed entering the burner, the method comprising: (a) providing a holding vessel having an interior chamber, the holding vessel having an interior chamber, at least one inlet opening and at least one outlet opening; (b) feeding a solid particulate feed material into the interior chamber through said at least one inlet opening; (c) fluidizing the feed material in a lower zone of the interior chamber by injecting a fluidizing gas into the lower zone of the chamber; (d) discharging the fluidized feed material through the at least one outlet opening, wherein the at least one outlet opening is in flow communication with the lower zone of the interior chamber.

In some examples, the method further comprises: measuring, directly or indirectly, a quantity of said particulate feed material inside the interior chamber.

In some examples, the method further comprises: controlling an area of the at least one outlet opening in response to changes in the quantity of said particulate feed material inside the interior chamber.

According to another aspect, a feed flow conditioner is provided for a flash smelting concentrate burner, which integrates with a reaction shaft of a furnace. The feed flow conditioner includes a holding vessel, feed supply inlets, a discharge aperture, a fluidizing plate, a windbox, and fluidizing gas supply system. The holding vessel integrates with the burner feed chute, and has a discharge aperture there through to communicate with the feed chute of the burner via an intermediate conveying apparatus, such as a chute or air-slide. The feed supply inlets are mounted over the holding vessel and supply the feed flow conditioner with particulate feed. The discharge aperture, which is in the form of one or more openings arranged in one or more walls of the holding vessel may allow flow of the particulate feed into the conveying apparatus. The fluidizing plate, which forms the bottom of the holding vessel, contains a plurality of gas distributors such as tuyeres, porous pads, or porous membrane to supply the holding vessel with fluidizing gas, which fluidizes the particulate feed, creating a suspension of feed within the holding vessel, thereby promoting the flow of the particulate feed through the aperture and into the feed chute of the burner via the conveying apparatus. The windbox, which is mounted underneath the fluidizing plate, is fitted with a fluidizing gas supply system to deliver and distribute fluidizing gas throughout the entire windbox.

According to another aspect, a method for improving the combustion performance of a flash smelting concentrate burner is provided, which delivers feed to a flash smelting concentrate burner with low spatial non-uniformity and with greatly reduced low-frequency fluctuations, regardless of the spatial and temporal flow characteristics of the feed delivered upstream of the system. The method utilizes a fluidized holding vessel with sufficient buffer capacity to absorb any fluctuations in the incoming feed. The discharge rate of the holding vessel is controlled, in response to operator input or long-term changes in the incoming feed rate. Control of the discharge rate is achieved by manually or automatically adjusting the aperture size, the fluidizing air flow rate, or the height of the fluidized bed.

In some examples, the discharge aperture is one or more holes or slots that are arranged in one or more of the walls of the holding vessel.

In some examples, the discharge aperture opening height can be modified through the use of an adjustable gate to control the discharge rate.

BRIEF DESCRIPTION OF THE DRAWINGS

In order that the claimed subject matter may be more fully understood, reference will be made to the accompanying drawings, in which:

DETAILED DESCRIPTION OF EMBODIMENTS

In the following description, specific details are set out to provide examples of the claimed subject matter. However, the embodiments described below are not intended to define or limit the claimed subject matter. It will be apparent to those skilled in the art that many variations of the specific embodiments may be possible within the scope of the claimed subject matter.

Figure 1:
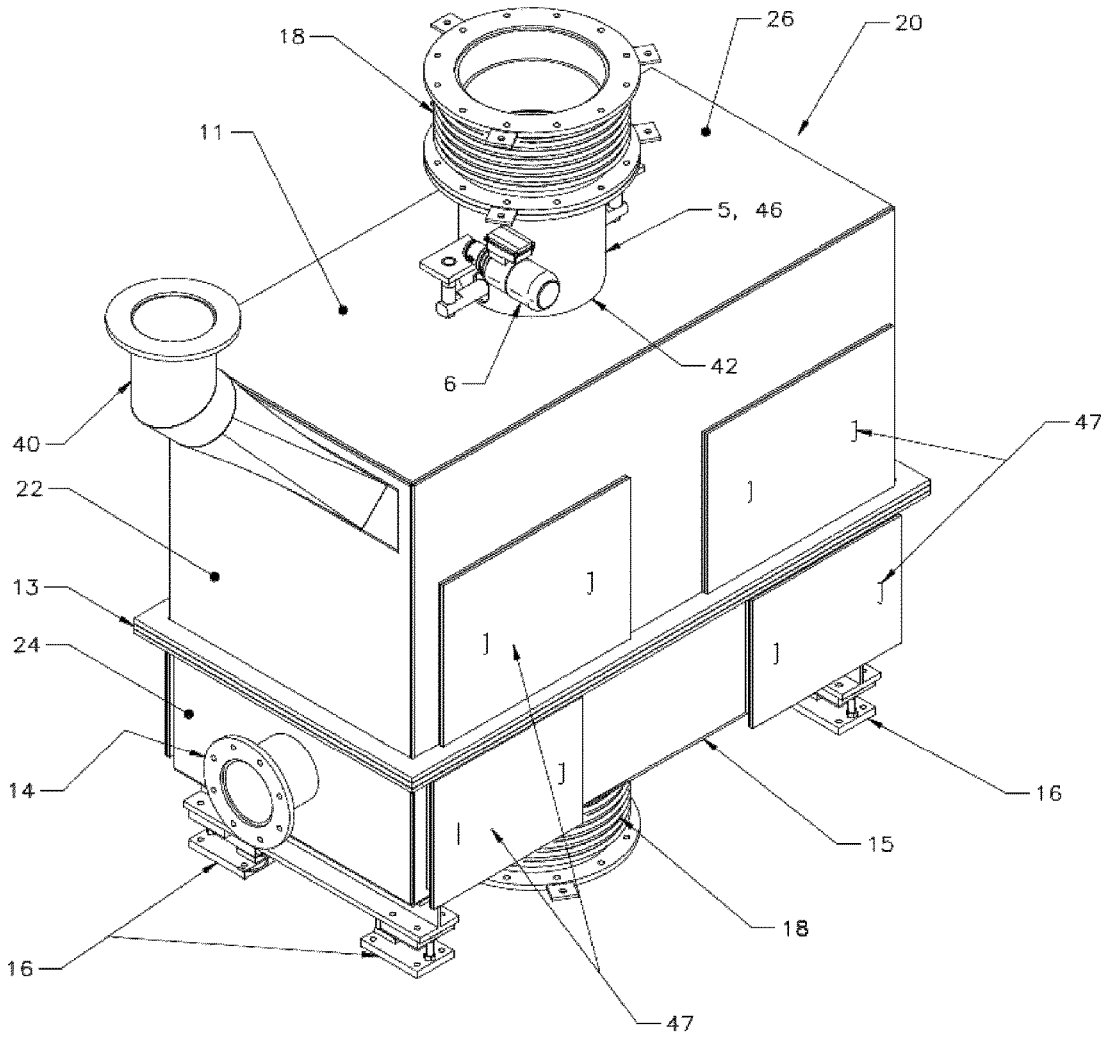
FIG. 1 is an isometric view of a feed flow conditioner according to one embodiment.

FIG. 1 is an isometric view of the exterior of a feed charging device 20 according to one embodiment of the invention. The two main components of the feed charging device 20 visible in FIG. 1 are a holding vessel 11 for holding a reserve of a solid particulate feed material, and a windbox 15 for providing a distributed flow of a fluidizing gas to the holding vessel 11. As shown, the holding vessel 11 is located above the windbox 15. The feed charging device 20 is shown in FIGS. 1 and 2 in the approximate orientation in which it is intended to be used.

The feed charging device 20 is shown as having an overall box-like shape, with the holding vessel 11 and the windbox 15 each having a side wall 22 or 24 comprising four side wall sections. In addition, the holding vessel 11 has a top wall 26 and the windbox 15 has a bottom wall 28. It will be appreciated that the box-like shape is not essential for proper operation of the feed charging device 20, and that the feed charging device may have any suitable shape, including cylindrical.

Figure 2:
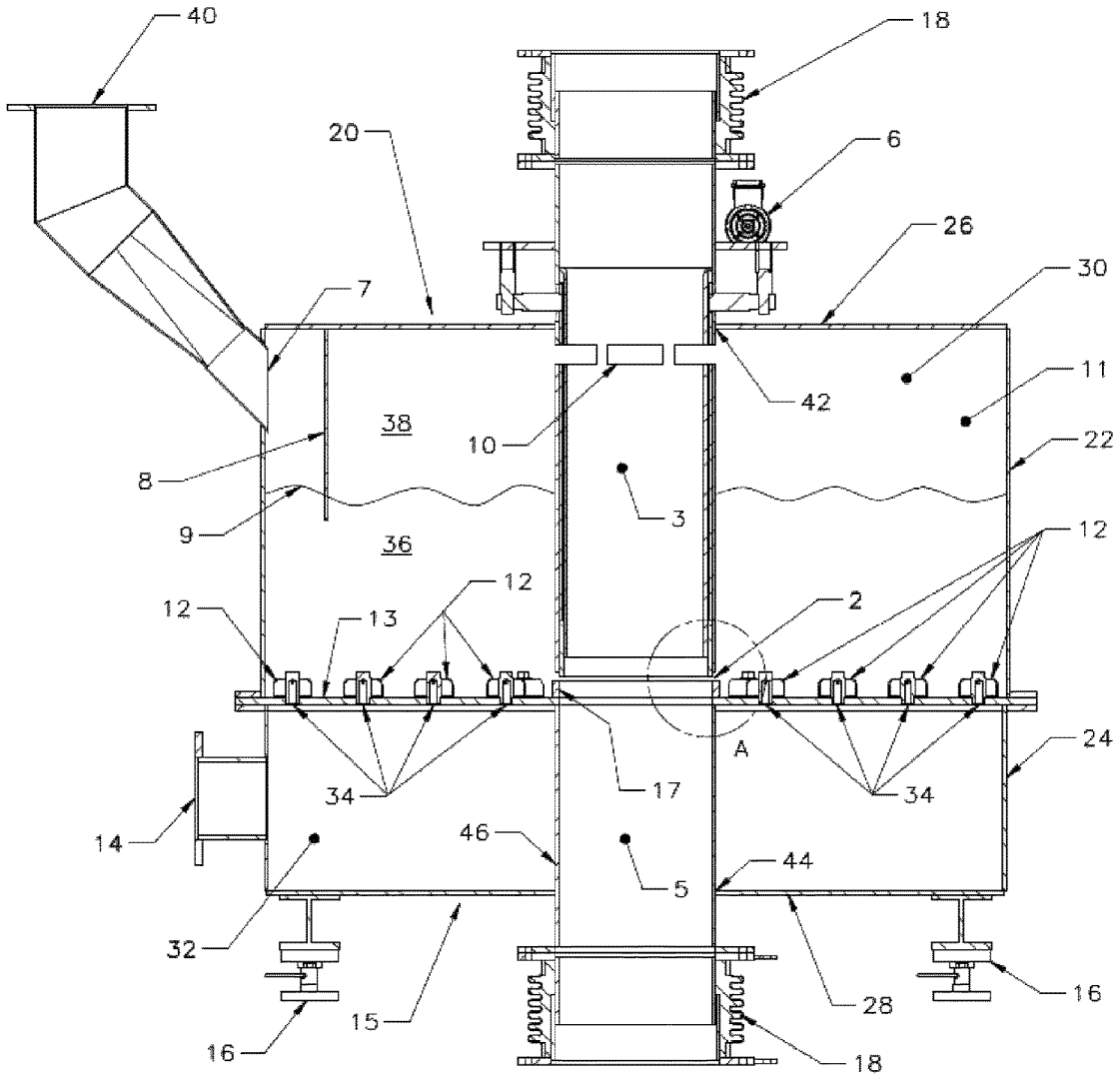
FIG. 2 is a cross-sectional view of the first embodiment of a feed flow conditioner.

As shown in the cross-sectional view of FIG. 2, the holding vessel 11 has an interior chamber 30 for holding a reserve of the solid particulate feed material in a fluidized state, and the windbox 15 encloses a gas distribution chamber 32. The interior chamber 30 has an adequate volume to hold a fluidized bed 9 of the particulate feed material in a lower zone 36 of the interior chamber 30, with the interior chamber also including an upper zone 38 which comprises a gas space above the fluidized bed 9, and sometimes called "a freeboard". The interior chamber 30 must be of sufficient size to provide a buffer for any material surplus or deficit that results from fluctuations in the upstream elements of the feed system. The sizing of the interior chamber 30 will depend on the fluidization properties of the particulate feed material, and the magnitude of the fluctuations, and should be obvious to anyone skilled in the art.

As shown in FIGS. 1 and 2, the bottom of the holding vessel 11 comprises a bottom partition 13, which also forms a top wall of the windbox 15 and which separates the holding vessel 11 from the windbox 15. The bottom partition 13 comprises a plurality of apertures 34 through which the gas distribution chamber 32 is in flow communication with the interior chamber 30 of the holding vessel 11, and through which the fluidizing gas is supplied from the gas distribution chamber 32 to the interior chamber 30. The apertures 34 form part of a gas supply means of the feed charging device 20, which is further described below.

The holding vessel 11 further comprises at least one feed inlet opening 7, through which the feed material is supplied to the interior chamber 30 of the feed flow conditioner 20, for example from a particulate feed duct 40 through which the feed material is fed by gravity to the holding vessel 11. For purposes of illustration, the feed charging device 20 is shown in FIG. 2 as having one inlet opening 7 located in its side wall 22. However, it will be appreciated that two or more inlet openings 7 may be provided in different areas of the holding vessel 11, and that the at least one inlet opening may be provided in the side wall 22 or the top wall 26. As shown in the drawings, the at least one inlet opening 7 is provided in the side wall 22 of the holding vessel 11 and communicates with the upper zone 38 of the interior chamber 30.

The feed charging device 20 further comprises at least one outlet opening 2 through which the feed material is discharged from the interior chamber 30 of the holding vessel 11. The at least one outlet opening 2 is formed in the wall of an outlet conduit 5, sometimes referred to in this description as "discharge pipe 5". The outlet conduit 5 extends through the bottom partition 13 of the holding vessel 11 and extends into the interior chamber 30 thereof. In the illustrated embodiment, the outlet conduit 5 passes through the lower and upper zones 36, 38 of the interior chamber 30 and extends through a wall of the holding vessel 11 in the upper zone 38 of the interior chamber 30. For example, where the outlet conduit 5 is substantially vertically oriented, it extends vertically through the entire height of the holding vessel 11 and extends through an aperture 42 provided in the top wall 26 of the holding vessel 11, with the conduit 5 being sealed to the inner peripheral edge of the aperture 42 in the top wall 26.

Where the feed charging device 20 includes a windbox 15, the outlet conduit 5 also extends through an aperture 44 in the bottom wall 28 of the windbox 15 and through the gas distribution chamber 32. The outlet conduit 5 therefore provides a flow passage through which the particulate feed material in the fluidized bed 9 is discharged from the device 20.

In the illustrated embodiment, the bottom partition 13 comprises a rigid plate which may be substantially flat and horizontally oriented, also sometimes referred to herein as a "fluidizing plate 13". However, it will be appreciated that the bottom partition 13 is not necessarily flat and horizontal. Rather, the bottom partition 13 may be sloped and/or may have a dished or conical shape. The outlet conduit 5 is shown in the drawings as being centered within the feed charging device 20 around the discharge pipe 5. It can be appreciated that the outlet conduit 5 does not necessarily need to be centered within the feed charging device 20. For example, the position of outlet conduit 5 may be biased such that it is further away from the at least one inlet opening 7. Typically the outlet conduit 5 will be spaced from the side wall 22 of holding vessel 11 such that it is surrounded on all sides by the fluidized bed 9 of particulate feed material in the lower zone 36 of the interior chamber 30.

The interior chamber 30 of the holding vessel 11 communicates with the discharge pipe 5 through the at least one outlet opening 2 and is in flow communication with the fluidized bed 9 of particulate feed material in the lower zone 36. In the illustrated feed charging device 20 shown in FIG. 2-3, the at least one outlet opening 2 comprises a permanent aperture slit of fixed height, and which is horizontally oriented and extends continuously around substantially the entire outer perimeter of the conduit wall 46 of discharge pipe 5. The at least one outlet opening 2 is adapted to receive the feed material from a plurality of radial directions, and more specifically is adapted to receive the feed material along substantially the entire outer perimeter of the conduit wall 46. This radial inflow of feed material through the at least one outlet opening 2 provides an axisymmetric and spatially uniform discharge of particulate feed from the bottom end of feed flow conditioner 20, which is integrated to equipment requiring particulate feed, for example a concentrate burner of a flash smelting furnace (not shown). The top end of discharge pipe 5 may connect to off-gas ducting or possibly an alternate feed bypass chute (not shown), which would allow maintenance of the feed charging device while allowing feed to continue to supply the equipment downstream (below device 20).

Although the at least one outlet opening 2 is shown as comprising a single, continuous aperture slit, it will be appreciated that other configurations are possible. For example, the at least one outlet opening 2 may comprise a plurality of openings or slits which are spaced apart along substantially the entire outer perimeter of the conduit wall 46, such that the at least one outlet opening 2 is open to the lower zone 36 of the interior chamber 30, and the fluidized bed 9 located therein, along substantially the entire outer perimeter of the conduit wall 46. Where the at least one outlet opening 2 comprises a plurality of openings or slits, they are separated by webs which may be integral with the wall 46 of the outlet conduit 5.

The holding vessel 11 is designed to provide adequate capacity to allow some self-regulation of the fluidized bed 9 level movement. In other words, if the feed rate from the feed inlet 7 is increased, the fluidized bed 9 level will rise, which will increase the discharge flow of particulate feed through the at least one outlet opening 2, without a requiring a change to any other operating parameters.

The at least one outlet opening 2 is located in close proximity to the bottom partition 13, and a bottom threshold of the at least one outlet opening 2 is formed by a replaceable baffle ring 17, which prevents coarse particles within the fluidized bed 9 of particulate feed material from partially or completely blocking the at least one outlet opening 2. The baffle ring 17 also reduces local effects of the fluidizing gas on the discharge path created by the at least one aperture 34.

To allow control of the discharge rate, the area of the at least one outlet opening 2 is adjustable. For the example shown in FIGS. 2-3, the outlet conduit 5 in which the at least one outlet opening 2 is formed may include a continuously slidable cover member which is movable from a first position in which the area of the at least one outlet opening 2 is at a maximum, to a second position in which the area of the at least one outlet opening 2 is at a minimum, or even fully closed. It can be appreciated that the slidable cover member may be a vertically moving or rotating component used to adjust the area of the at least one outlet opening 2, or any other means of adjusting the outlet opening 2 can be used.

Figure 3:
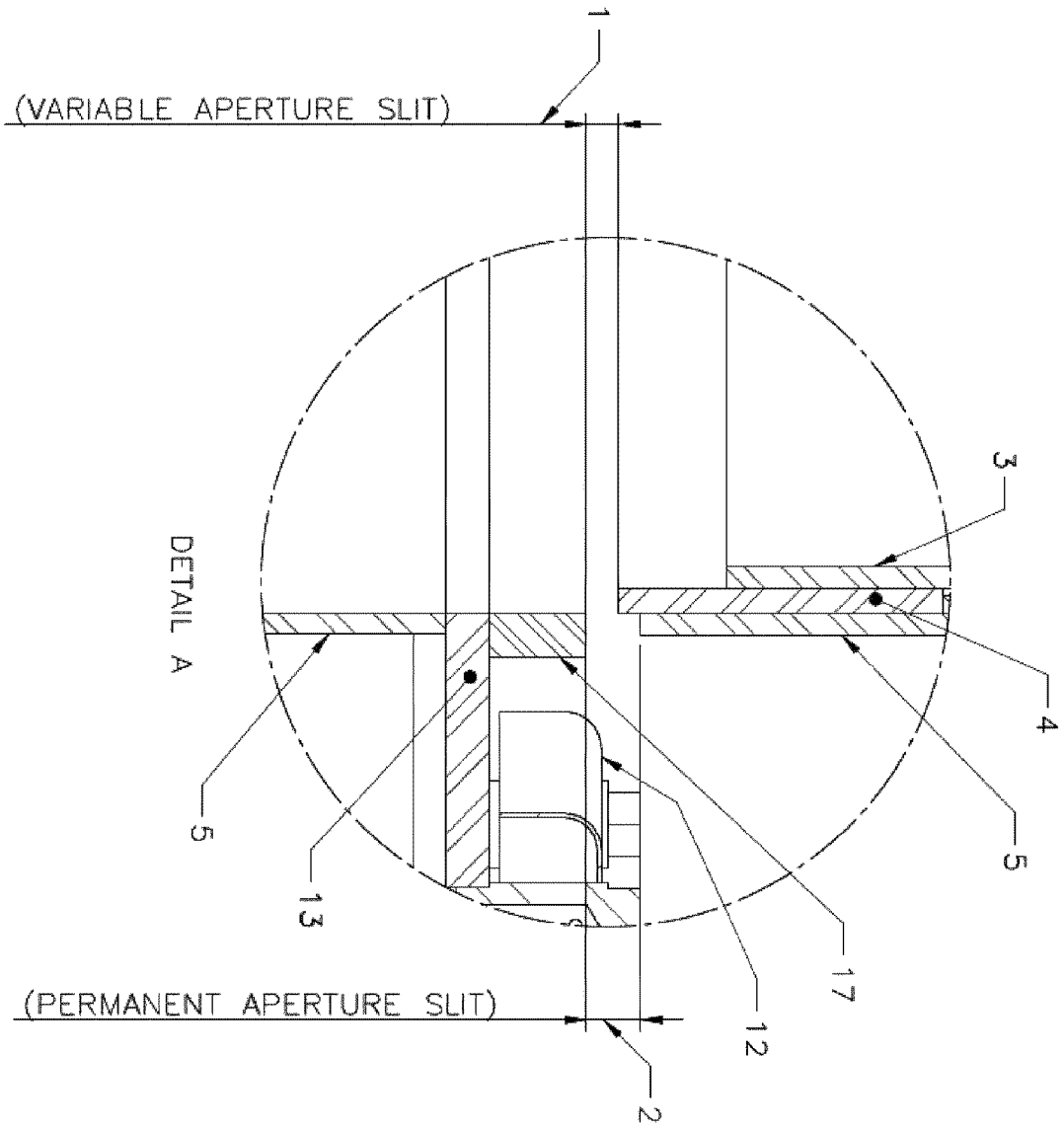
FIG. 3 is a detailed view of the adjustable aperture shown in the first embodiment of a feed flow conditioner.

For example, in the embodiment shown in FIGS. 2-3, in which the at least one outlet opening 2 comprises a substantially continuous slit, the outlet conduit 5 may comprise a cylindrical sliding sleeve 4. The sleeve 4 is vertically (longitudinally) slidable along a surface of the outlet conduit 5 between the first and second positions, such that the slit 2 has a greater height with the sleeve 4 in the first position than in the second position. As shown in FIG. 3, the sliding sleeve 4 is sandwiched between the outer fixed layer of the outlet conduit 5 and an internal fixed layer 3, allowing a variable aperture slit 1 to form in the outlet conduit 5, and effectively reducing the area of the continuous slit comprising the at least one outlet opening 2. FIG. 3 illustrates the second position of the sliding sleeve 4, wherein the effective open area of the at least one outlet opening 2 is at a minimum, but the at least one outlet opening 2 remains partially open. The first position is defined where the sliding sleeve 4 is raised so that the variable aperture slit 1 has an area at least equal to the area of the at least continuous slit 2.

As can be seen from the above description, the variable aperture slit 1 allows the axisymmetric and spatially uniform discharge feed rate to be controlled, and can be increased in height and area to increase the discharge rate (up to a maximum area equal to that of the at least one outlet opening 2), or reduced to decrease the discharge rate by moving the cylindrical sliding sleeve 4. The movement of the cylindrical sliding sleeve 4 is controlled by an actuation mechanism 6 for moving the sliding sleeve 4 between the first and second positions. In the illustrated embodiment, the actuation mechanism 6 is located above the feed flow conditioner 20 and comprises a power screw, which converts the rotational motion of the motor to the vertical motion required of the cylindrical sliding sleeve 4 in this embodiment. It can be appreciated that any actuation mechanism 6, positioned at any location, can be used to adjust the outlet opening area.

Where the gas supply means of the feed charging device 20 includes a windbox 15, the windbox 15 may be supplied with the fluidizing gas through a fluidizing gas inlet nozzle 14, and is separated from the holding vessel 11 by the bottom partition 13, which may be in the form of a fluidizing plate. The fluidizing plate 13 contains a plurality of apertures 34, which may be defined by a plurality of high precision tuyeres 12, which allow the fluidizing gas to enter the holding vessel 11, as shown in FIGS. 2-3. The tuyeres 12 are received in the bottom partition 13 in spaced relation to one another, and may be radially dispersed around the conduit wall of the outlet conduit 5, so as to provide a substantially uniform circumferential fluidization and suspension of the particulate feed within the lower portion 36 of interior chamber 30. In addition, the windbox 15 provides uniform distribution of the fluidizing gas throughout the gas distribution chamber 32, thereby distributing the fluidizing gas across substantially the entire fluidizing plate 13 before it enters the tuyeres 12.

Instead of tuyeres 12, it will be appreciated that the bottom partition 13 may be partially or entirely comprised of one or more porous pads or porous membranes, and wherein the apertures 34 of bottom partition 13 are defined by the porous pads or porous membranes.

The holding vessel 11 further includes at least one off-gas outlet opening 10, which is provided in the conduit wall of the outlet conduit 5, and allows the fluidizing gas to be discharged from the device 20. The at least one off-gas outlet opening 10 is located above the height of the fluidized bed 9 of particulate feed, in communication with the upper zone 38 of interior chamber 30. This allows the collecting of elutriated fines that are carried with the off-gas from the fluidized bed 9, which will be discharged downwards through the discharge pipe 5, with the rest of the particulate feed.

Inside the holding vessel 11, a deflector plate 8 is positioned in the upper zone 38 of interior chamber 30 between the feed inlet opening 7 and the off-gas outlet opening 10. The deflector plate 8 eliminates short circuiting of fines from the feed inlet 7 to the at least one off-gas outlet opening 10. The deflector plate 8 may be oriented substantially vertically and the lower edge of the deflector plate 8 may be submerged into the fluidized bed 9, as shown in FIG. 2, to prevent the exhaust of the fluidizing gas to the feed inlet 7 and protect the upstream feed equipment from dust.

Multiple actuated valves (not shown) mounted externally to the feed charging device 20 are governed by a PLC (programmable logic control) or other mechanical or electronic feedback controller and control the volumetric flow rate of the fluidizing gas, maintaining a required fluidization velocity in the bed 9 using feedback from a pressure sensor (not shown) positioned within the bottom zone 36 of the fluidized bed 9 immediately above the fluidizing plate 13. If required the flow rate of the fluidizing gas can be used to control the discharge rate of the particulate feed into the outlet conduit 5, along with the adjustment of the area of outlet opening 2.

Pressure sensors (not shown) are also located in the holding vessel 11, in the freeboard above the fluidized bed 9 level of particulate feed, as well as at the bottom of the fluidized bed 9, immediately above the bottom partition 13. This arrangement measures the pressure drop through the fluidized bed 9 and provides feedback to the PLC. This data is used to monitor the weight of the particulate feed within the feed flow conditioner 20, as well as the level of fluidized bed 9. The PLC can adjust the outlet opening 2 by, for example, changing the height of the variable aperture slit 1, or flow rate of the fluidizing gas, to control the discharge rate of the particulate feed through the outlet conduit 5.

Load cells 16 are placed at the bottom of the feed flow conditioner to support and accurately measure the weight of the feed flow conditioner 20 and its contents. The load cells 16 can be used to accurately measure/calibrate the mass flow rate of the particulate feed through the feed flow conditioner 20, by deliberately stopping the flow of particulate feed to the inlets 7 for a short period of time and measuring the rate of weight loss. In addition, the load cells 16 can effectively monitor the fluidized bed 9 level.

The feed flow conditioner can utilize expansion joints 18 that isolate the feed flow conditioner 20 from the burner downstream (below device 20), as well as the off-gas equipment upstream (above device 20). The expansion joints 18 isolate the feed flow conditioner 20 from the rest of the system and allow the weight of the feed flow conditioner 20 and its contents to be accurately weighed by the load cells 16. The expansion joints 18 also allow thermal expansion of the feed flow conditioner 20 and are connected to the feed flow conditioner 20 other equipment such as a burner, feed and off-gas ducts.

Both the windbox 15 and holding vessel 11 contain multiple access ports for inspection, cleaning and adjustment of the internals, the ports being covered by plates 47 when the device 20 is in use.

It will be appreciated by those skilled in the art that many variations are possible within the scope of the claimed subject matter. The embodiment shown in FIG. 1-3 that has been described above is intended to be illustrative and not defining or limiting. For example, the tuyeres 12 used to inject fluidizing gas into the holding vessel 11 can be individually controlled, or they can be controlled in groups or clusters. The apertures 34 in the fluidizing plate 13 may contain porous ceramic pads or a porous membrane, or the bottom partition 13 can be fabricated as a frame holding porous material such as a fabric type, which has sealed connection to the frame. The discharge direction and velocity of the fluidizing gas could also be adjusted, mechanically or by other means.

Figure 4:
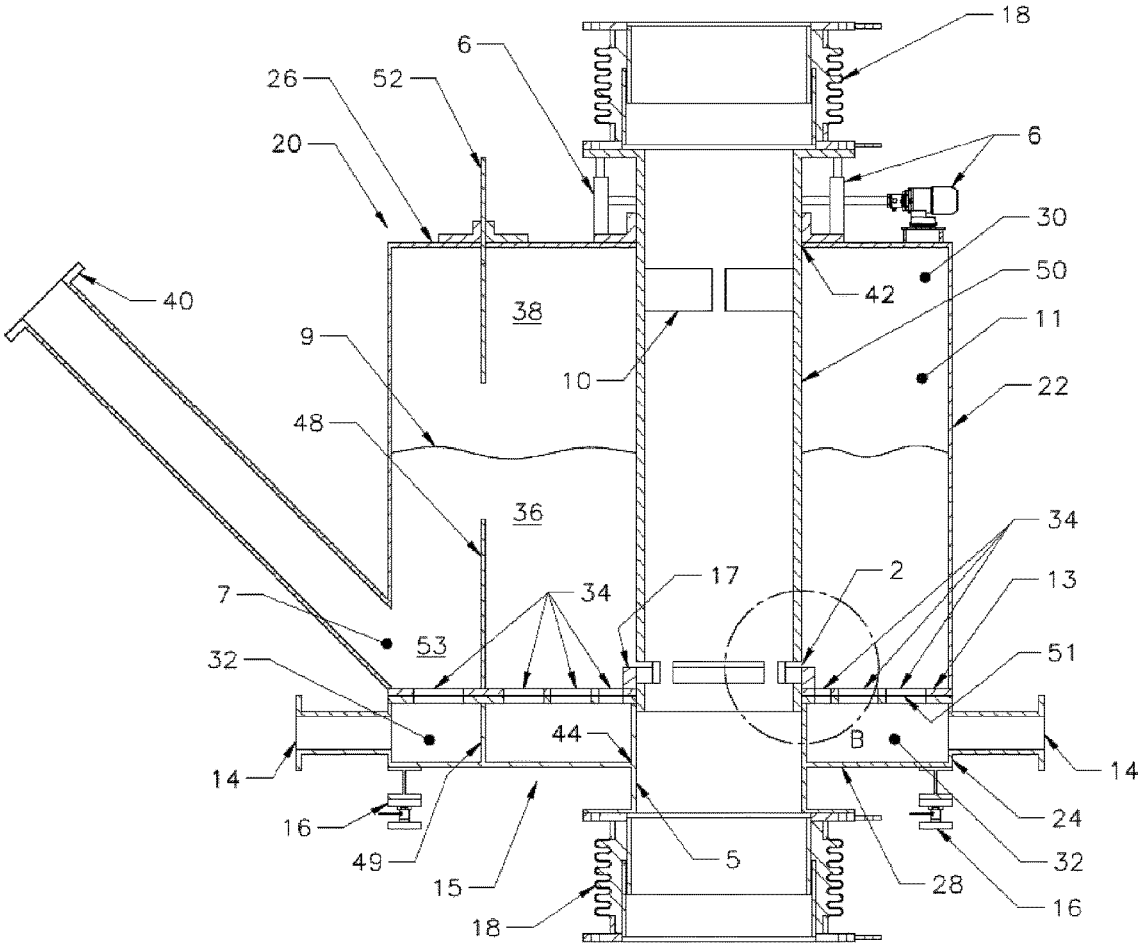
FIG. 4 is a cross-sectional view of a second embodiment of a feed flow conditioner.
Figure 5:
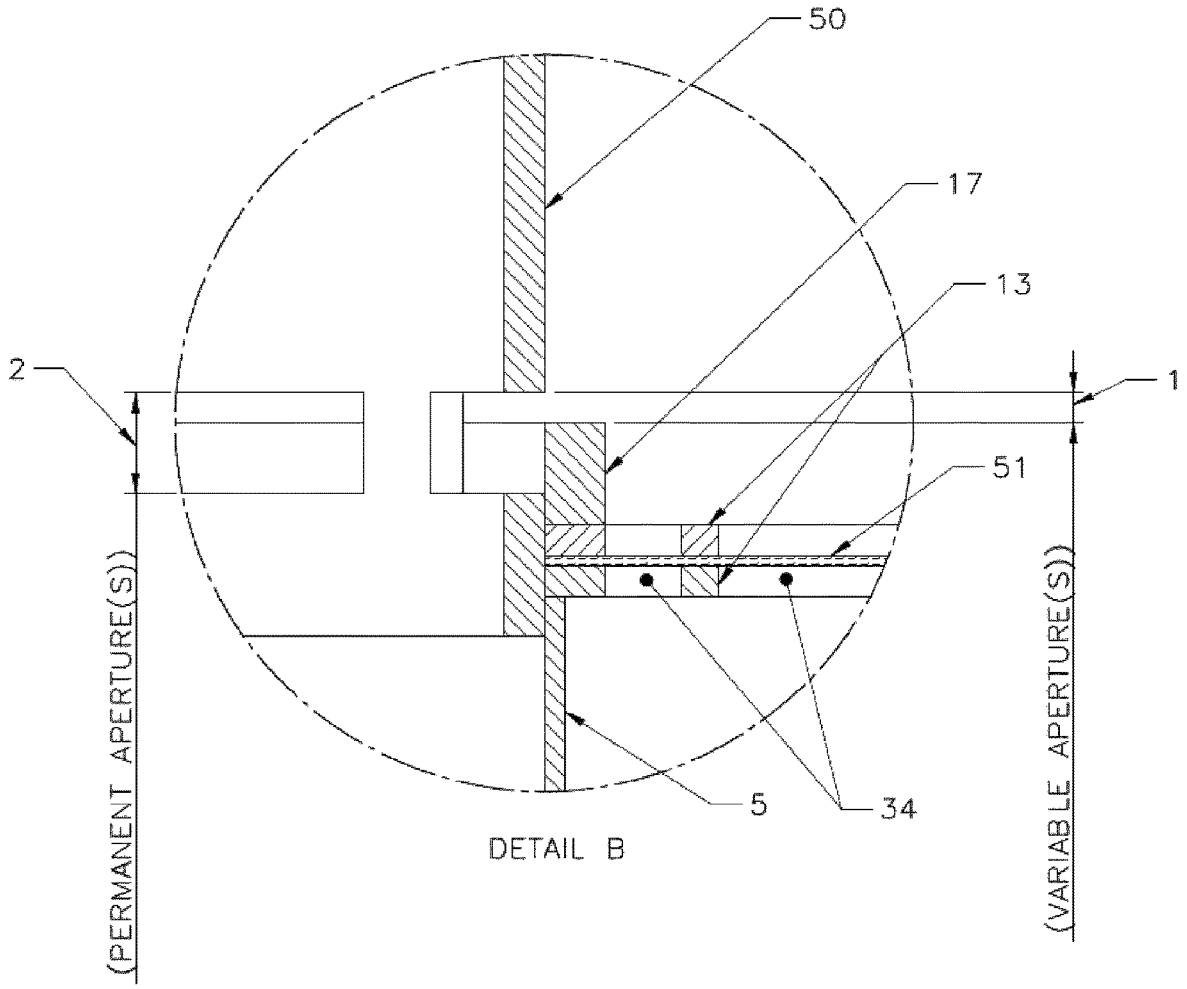
FIG. 5 is a detailed view of the adjustable aperture and porous membrane shown in the second embodiment of a feed flow conditioner.

To illustrate some of the variations possible, FIGS. 4 and 5 illustrate a second embodiment of the invention, with FIG. 5 providing a detail view of the outlet area shown in FIG. 4. Similar components as those shown in FIG. 1-3 are given like reference numbers, and their description will not be repeated. Only components differing from the first embodiment shown will be described to provide examples of the additional features or variations of the design that are discussed herein.

In the embodiment shown in FIGS. 4 and 5, the feed inlet opening 7 is positioned close to the bottom of the holding vessel 11 and close to fluidizing plate 13, so the feed is introduced into the holding vessel 11 below the top of the fluidized bed 9.

The windbox 15 is separated from the holding vessel 11 by the bottom partition 13, which is in the form of two fluidizing plates that sandwich a porous membrane 51 in between. The bottom partition 13 contains a plurality of apertures 34, in both plates, which allow the fluidizing gas to enter the holding vessel 11 through the porous membrane 51. However, it will be appreciated that the bottom partition 13 may instead comprise a single apertured plate 34 with tuyeres 12, as in the first embodiment.

The windbox 15 consists of separate compartments, which are separated and sealed by a divider plate 49. Each of the compartments is supplied with fluidizing gas from separate fluidizing gas inlet nozzles 14.

A permanent baffle plate 48 is positioned on the top surface of the fluidizing plate 13 and protrudes into the fluidized bed 9. The position and shape of the baffle plate 48 can be modified to optimize the feed distribution from the feed inlet 40 along the holding vessel 11 to achieve uniform residence time for the particulate in the holding vessel 11. In the embodiment shown in FIG. 4, the upper edge of the baffle plate 48 is located within the fluidized bed 9, i.e. in the lower zone 36.

It can be seen that the baffle plate 48 and the windbox divider plate 49 at least partially define a feed inlet zone 53 within the chamber 30 of vessel 11, and that the separation of the windbox 15 into separate compartments allows different amounts of fluidizing gas to be supplied to the fluidized bed within the feed inlet zone 53. This arrangement allows the particulate feed entering at the feed inlet 7 to be pneumatically elevated, minimizing elutriation of dust in the freeboard due to the freefall of particulate material through the feed inlet 7. This also minimizes fluidizing gas percolation into the feed inlet 7. The feed inlet zone 53 functions as a check on the flow of feed into the fluidized bed 9. By connecting feed inlet 7 directly to a feed bin, and varying the flow of air to the windbox compartment 32 in this arrangement, the feed flow conditioner 20 can also be used as a feeder.

A deflector plate 52 is positioned in the upper zone 38 of interior chamber 30 between the feed inlet opening 7 and the off-gas outlet opening 10. The deflector plate 52 extends downwardly from top wall 26 and is positioned with its lower edge located above the fluidized bed 9 and above the upper edge of baffle plate 48 to provide a passage for flow of gas and particulates out of the feed inlet zone 53 and into the main portion of chamber 30. The position and shape of deflector plate can be modified to minimize the amount of dust that enters the holding vessel 11 or the off-gas vents 10 from the feed inlet opening 7.

In the embodiment shown in FIGS. 4 and 5, the feed charging device 20 further comprises at least one outlet opening 2 through which the feed material is discharged from the interior chamber 30 of the holding vessel 11. The at least one outlet opening 2 is formed in the wall of a sliding outlet conduit 50, and in this embodiment comprises a plurality of openings that are separated by webs 55 which are integral with the wall of the sliding outlet conduit 50.

The sliding outlet conduit 50 passes through the lower and upper zones 36, 38 of the interior chamber 30, extends vertically through the entire height of the holding vessel 11, and extends through an aperture 42 provided in the top wall 26 of the holding vessel 11, with the sliding outlet conduit 50 being sealed to the inner peripheral edge of the aperture 42 in the top wall 26. The sliding outlet conduit 50 extends downwards through the baffle ring 17, and may extend downwardly through the bottom partition 13, the sliding conduit 50 being sealed to the inner peripheral surface of the baffle ring 17.

The sliding outlet conduit 50 is positioned such that the outlet openings 2 are located in close proximity to the bottom partition 13, and the replaceable baffle ring 17. By varying the vertical position of the sliding outlet conduit 50, the outlet openings 2 can be movable from a first position away from the baffle ring 17 in which the area of the outlet openings 2 is open and at a maximum, to a second position in which the area of the at least one outlet opening 2 is constricted by the baffle ring 17 to a minimum. The sliding outlet conduit 5, together with baffle ring 17, thus define a variable aperture 1. For example, FIG. 4 shows the area of the variable aperture 1 at a minimum, with most of the area of the outlet opening 2 being covered by the baffle ring 17. FIG. 5 also shows the minimum area (dimension of variable aperture 1 on right side of FIG. 5) and the maximum area (dimension of permanent aperture 2 on left side of FIG. 5) of the outlet opening, which is equal to the area of the at least one outlet opening 2.

The movement of the sliding outlet conduit 50 is controlled by an actuation mechanism 6 which may be the same as the actuation mechanism 6 described above.

In some examples, the off-gas discharge opening 10 can be at the top of the holding vessel 11 and can be equipped with a bin vent dust collector (not shown). In some examples, the holding vessel 11 would contain a plurality of feed inlet openings 7 to supply particulate feed. Such a configuration would allow a feed flow conditioner 20 to be positioned on top of an existing concentrate burner, with the feed supply system interfacing with the feed inlets. This arrangement would allow a bypass valve to divert the particulate feed from the feed supply system directly through the top of the outlet conduit 5, allowing maintenance to occur on the feed flow conditioner 20 without taking it offline.

Figure 7:
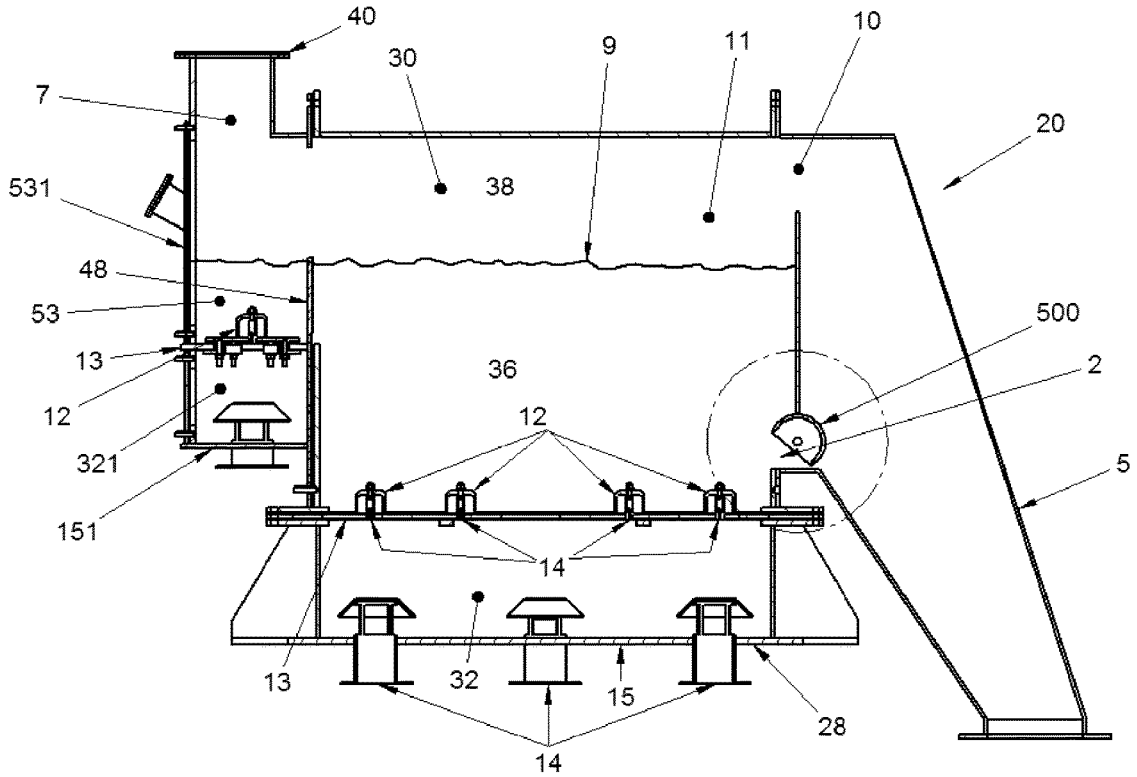
FIG. 7 is a cross-sectional view of a third embodiment of the feed flow conditioner with the aperture located on one of the walls of the holding vessel.
Figure 8:
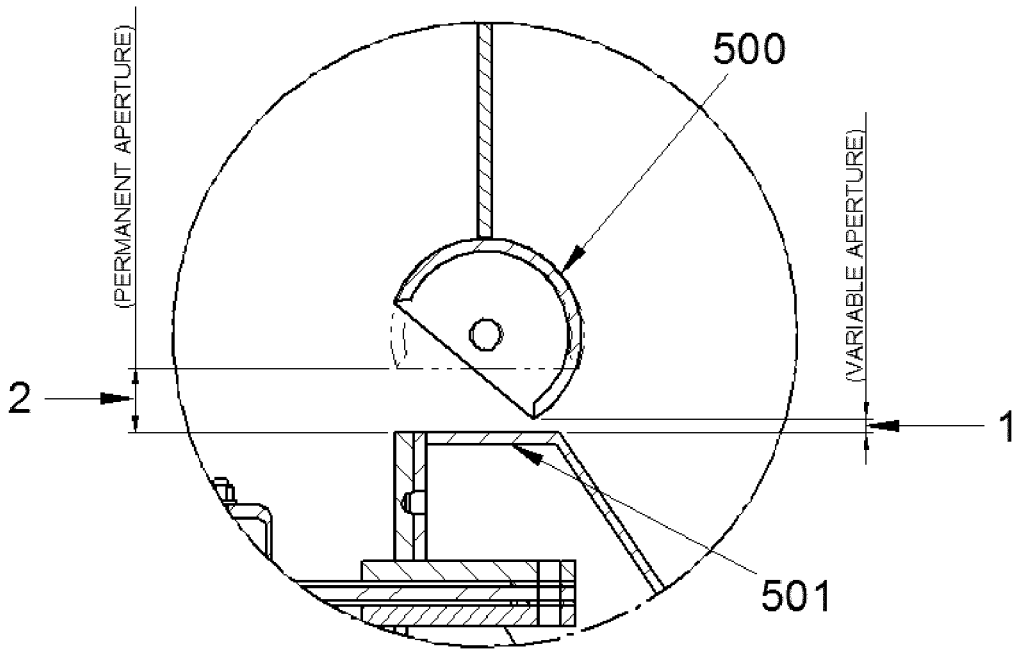
FIG. 8 is a detailed view of the adjustable aperture in the third embodiment of a feed flow conditioner.

To illustrate some of the variations possible, FIG. 7 provides a cross-sectional view of a further embodiment of the invention. Similar components as those shown in FIG. 1-5 are given like reference numbers, and their description will not be repeated. Only components differing from the first or second embodiments will be described to provide examples of the additional features or variations of the design that are discussed herein. FIG. 8 provides a detail view of the outlet area shown in FIG. 7.

The embodiment of FIG. 7 includes a feed inlet zone 53 similar to that described above in connection with FIGS. 4 and 5. The feed inlet zone 53 comprises a separate fluidized feeding compartment 531, with an independent inlet windbox 151 which corresponds in function to the separate compartment of windbox 15 under the feed inlet zone 53 in the second embodiment shown in FIG. 4. The holding vessel 11 contains a permanent baffle plate 48 that is positioned within the fluidized bed 9, between the fluidized feeding compartment 531 and the interior chamber 30. The height of the baffle plate 48 can be below or above the level of the fluidized bed.

The feed charging device 20 of FIG. 7 further comprises at least one outlet opening 2 through which the feed material is discharged from the interior chamber 30 of the holding vessel 11. Instead of being located in a discharge pipe 5 or a sliding outlet conduit 50 as in the first two embodiments, the at least one outlet opening 2 is formed in the wall of holding vessel 30, and is located above the fluidizing plate 34 as in the first two embodiments. The area of outlet opening 2 is varied by a valve mechanism 500, which comprises a section of a cylinder with a flat face, and which is rotatable about a horizontal axis. The size of the outlet opening 2 can be varied by rotating the partially-cylindrical valve mechanism 500 about its axis between two angular positions, to define a variable aperture 1. FIG. 7 shows the valve mechanism 500 in a partially closed position which defines the minimum area of variable aperture 1.

FIG. 8 illustrates the valve in a partially closed position. Rotating the valve mechanism 500 counter-clockwise about its axis creates a rectangular variable aperture 1 between the edge of the valve mechanism 500 and the floor of the discharge chute 501. The maximum opening of the variable aperture 1 is defined by allowed angular rotation limits and dimensions of the partially-cylindrical valve mechanism 500 and in this embodiment will be defined by an orientation where the flat face of the valve mechanism 500 is oriented horizontally.

As can be seen from the above description, the variable aperture 1 allows the rectangular spatially uniform discharge feed rate to be controlled, and can be increased in height and area to increase the discharge rate by rotating the valve mechanism 500 counter clockwise, or reduced to decrease the discharge rate by rotating the valve mechanism 500 clockwise. The movement of the valve mechanism 500 is controlled by an actuation mechanism (not shown) for rotating the valve mechanism 500. It can be appreciated that valve mechanism 500 can be replaced by other known actuated valves, such as knife gates or slide gates, to form an outlet aperture 1 of any desired plane shape.

As shown in this embodiment, the windbox 15 may consist of separate compartments, with each containing a specific arrangement of tuyeres 12 in the fluidized plate 34 to allow modification of the fluidizing characteristics within the holding vessel 11.

In some examples the variable aperture slit 1 can be replaced by a series of holes or slot openings, where the adjustment of the aperture cross-sectional area can be an internal sleeve controlled either vertically or rotationally.

The embodiments specifically described below are feed charging devices for a flash smelting furnace including an elevated reaction shaft having a burner where particulate feed material and reaction gas are brought together and reacted. However, it will be appreciated that the devices described below could be adapted for use in other fields using particulate feed systems, such as in the pharmaceutical, chemical and food production and processing industries.

Figure 6:
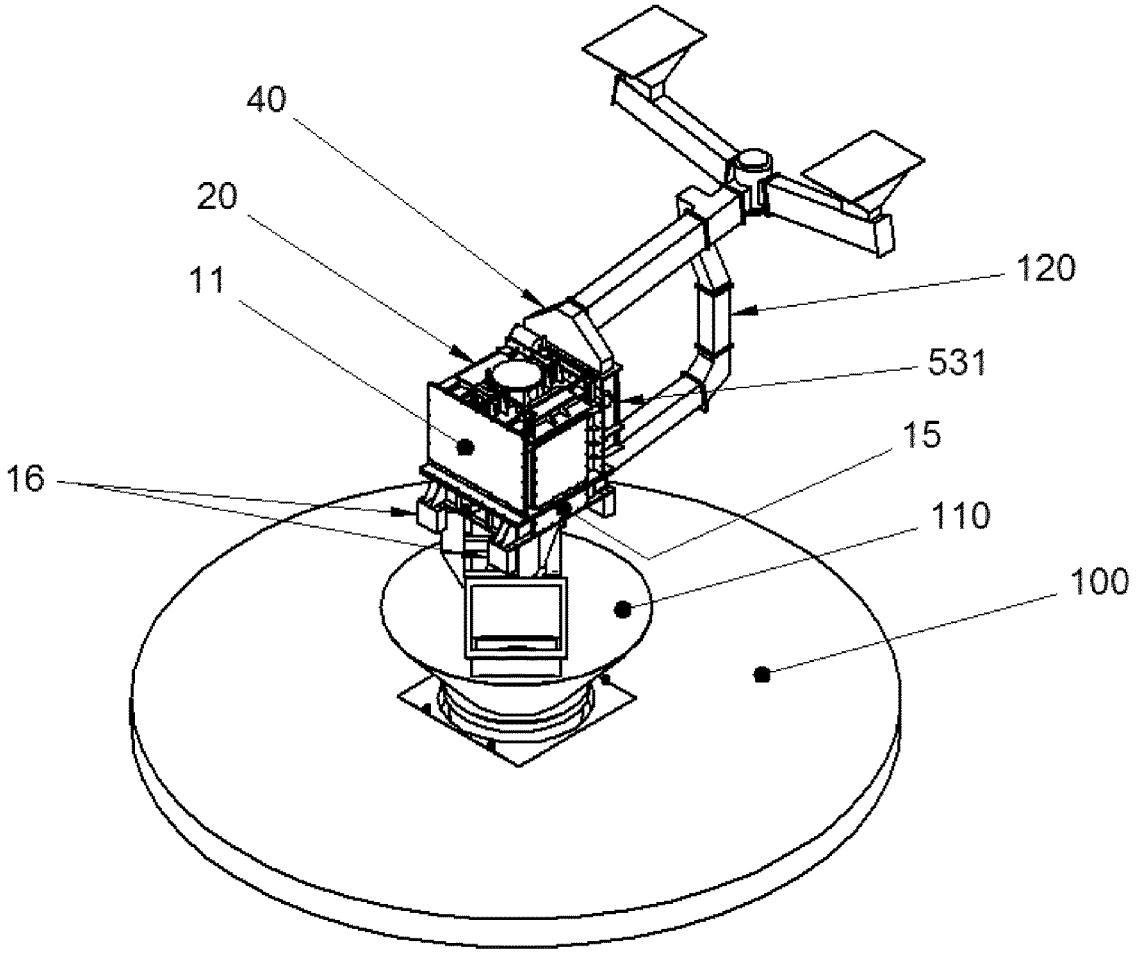
FIG. 6 is a typical layout of flash smelter furnace, showing the burner and feed flow conditioner in a possible arrangement.

FIG. 6 illustrates a further embodiment of the invention and a possible configuration of a flash smelter furnace 100 with a burner 110 and feed flow conditioner 20, sometimes referred to herein as a "feed charging device". The feed flow conditioner 20 of FIG. 6 may take the form of any of the feed flow conditioners according to the first three embodiments, or variants thereof. Similar components as those shown in FIGS. 1-5, 7 and 8 are given like reference numbers, and their description will not be repeated. Only components differing from the first three embodiments will be described to provide examples of the additional features or variations of the design that are discussed herein.

In the embodiment shown in FIG. 6, the feed charging device 20 comprises a holding vessel 11 and is shown as having a feeding compartment 531 for receiving feed from a conventional feeding system (not shown) through feed ducts 40. The feed charging device 20 integrates directly with the top of a concentrate burner 110. This arrangement allows feed material to be charged directly to the burner 110 via the charging device 20, or an alternative pathway through the bypass chutes 120.

In the embodiment shown in FIG. 6, the feed charging device 20 delivers feed directly to the burner 110, eliminating both feed fluctuations and spatial non-uniformity.

Figure 9:
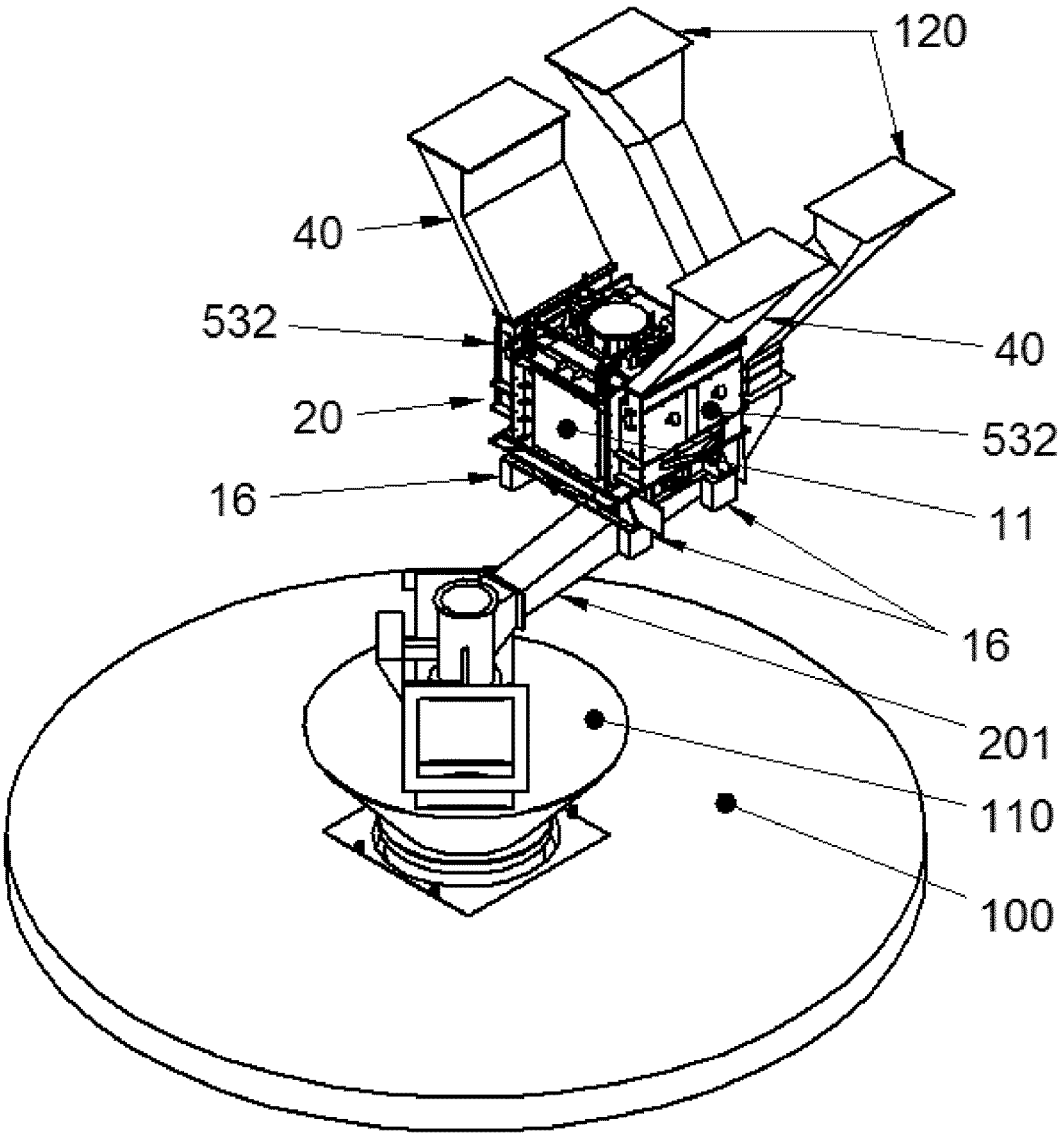
FIG. 9 is an isometric view of a typical layout of a reaction shaft roof, showing the burner and feed flow conditioner in a possible arrangement where the feed is delivered to the burner via an intermediate conveying apparatus.

FIG. 9 illustrates a further embodiment of the invention and a possible configuration of a flash smelter furnace 100 with a burner 110 and feed flow conditioner 20, sometimes referred to herein as a "feed charging device". Similar components as those shown in FIGS. 1-8 are given like reference numbers, and their description will not be repeated. Only components differing from the first four embodiments will be described to provide examples of the additional features or variations of the design that are discussed herein.

In the embodiment shown in FIG. 9, the feed charging device 20 comprises a holding vessel 11 and includes two separate feeding compartments 532, each of which may be similar to the feeding compartments 531 described above, for receiving feed from a conventional feeding system (not shown) through feed ducts 40. The feed charging device 20 integrates with a concentrate burner 110 via an intermediate conveying apparatus 201, in this case, an air-slide. This arrangement allows feed material to be charged to the burner via the charging device 20, or an alternative pathway through the bypass chutes 120.

In the embodiment shown in FIG. 9, the feed charging device 20 will eliminate feed fluctuations and provide spatially uniform feed to the burner feed chute. The ultimate spatial distribution of the feed will be impacted by the design of the mechanical components distributing the feed within the burner. This disadvantage is, to some extent, offset by the ease with which the embodiment shown in FIG. 9 can be integrated into an existing flash furnace burner feed system.

It will be appreciated by those skilled in the art that many installation variations are possible within the scope of the claimed subject matter. The embodiment shown in FIG. 9 that has been described above is intended to be illustrative and not defining or limiting. For example, the charging device can be configured to feed burners with multiple inlets or multiple burners through multiple variable apertures. Various inlet configurations can be utilized to adapt the charging device to existing feed systems. Also disclosed herein is a method for improving the combustion characteristics of a flash smelting burner by improving the temporal and spatial uniformity of the feed distribution supplied to the combustion space of a flash furnace, by the application of a fluidized holding vessel with a feedback-controlled discharge aperture as described above. This method will be further illustrated using the example below, which was simulated using a combination of transient computational fluid dynamics (CFD) modeling and computational particle fluid dynamics (CPFD) modeling.

EXAMPLE

A flash smelting furnace operating with a conventional feed system was simulated using an axisymmetric transient CFD model. Details of the modeling work can be found in a paper by Lamoureux et al. entitled "Impact of Concentrate Feed Temporal Fluctuations on a Copper Flash Smelting Process", http://onlinelibrary.wiley.com/doi/10.1002/9781118887998.ch52/summary. Three transient conditions, with identical time-averaged feed rates, were modeled: (1) ideal, temporally uniform feed; (2) intermittent feed injected with a frequency of 1 Hz, with an 80% duty cycle; and (3) intermittent feed injected with a frequency of 5 Hz, with an 80% duty cycle. The latter two cases correspond to the feed frequencies of a conventional feed system, and the modeled natural frequency of a feed flow conditioner (as described herein), respectively. Performance of the burner was evaluated on the basis of oxygen efficiency. The reported values for the intermittent feed case are relative to the oxygen efficiency of the ideal case. The simulation results shown below in Table 1 illustrate that for the same amplitude, low-frequency feed intermittency has a significant negative impact on burner oxygen efficiency, while high-frequency intermittency has a negligible impact.

TABLE 1

| | | Relative Oxygen Efficiency |
|---|---|---|
| 1 | Ideal, temporally uniform feed | 100.0% |
| 2 | Intermittent feed @ 1 Hz | 91.6% |
| 3 | Intermittent feed @ 5 Hz | 99.9% |

Furthermore to the above results, the impact of the amplitude of the intermittency was evaluated. Two additional transient conditions were modeled: 4. Sinusoidal intermittency, at a frequency of 1 Hz with an intermittency amplitude equal to 33% of the mean, and 5. Sinusoidal intermittency, at a frequency of 1 Hz with an intermittency amplitude equal to 50% of the mean. The simulation results shown below in Table 2 illustrate that for the same frequency, increasing intermittency amplitude has a correspondingly increasing negative impact on burner oxygen efficiency.

TABLE 2

| | | Relative Oxygen Efficiency |
|---|---|---|
| 1 | Ideal, temporally uniform feed | 100.0% |
| 4 | Sinusoidal Intermittent feed @ 1 Hz, 33% amplitude | 97.8% |
| 5 | Sinusoidal Intermittent feed @ 1 Hz, 50% amplitude | 93.7% |

Figure 10:
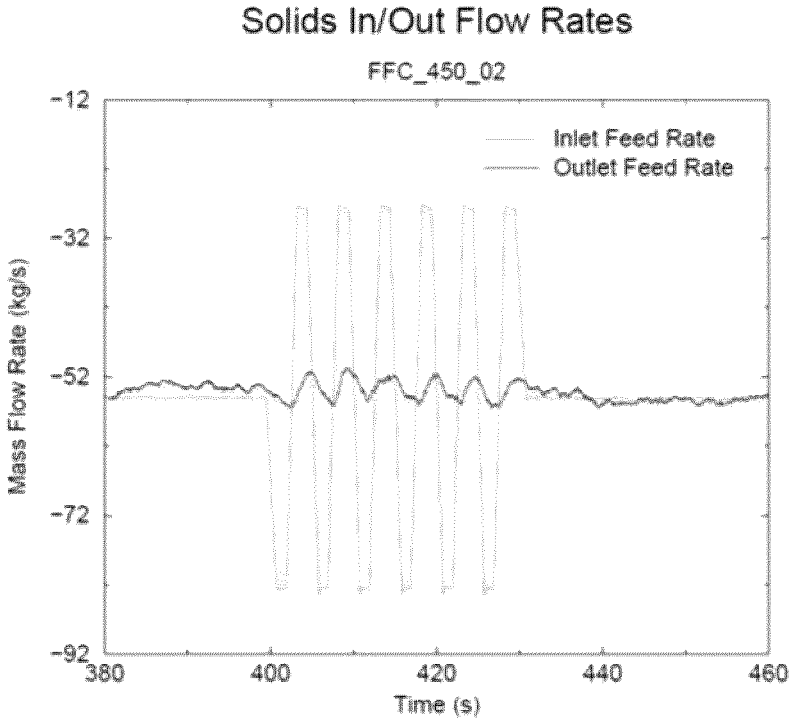
FIG. 10 is a graph of mass flow rate vs. time showing the capacity of the feed flow conditioners defined herein to reduce the impact of feed intermittency of conventional feed systems.

With the above in mind, the response of the feed flow conditioner to low frequency feed intermittency at the inlet was simulated using commercial CPFD software. The results, illustrated in FIG. 10, clearly show that the feed flow conditioner has a high capacity to attenuate the amplitude of low-frequency feed intermittency introduced at its inlet.

This indicates that the feed flow conditioner can, when introduced between a burner and a conventional feed system, reduce the impact of feed intermittency inherent in the conventional feed systems, thereby improving burner performance.

While the above subject matter has been described in the context of burners for flash smelting furnaces, it will be appreciated that it may also have application to other burners for particulate feed materials, such as burners for furnaces that are fueled by particulate coal, or other equipment requiring particulate feed.

What is claimed is:

1. A feed charging device, comprising:

(a) a holding vessel having an interior chamber for holding a reserve of a solid particulate feed material in a fluidized state, wherein the feed material is held in said fluidized state in a lower zone of the interior chamber;

(b) at least one inlet opening through which the feed material is supplied to the interior chamber;

(c) at least one outlet opening through which the feed material is discharged from the interior chamber, wherein said at least one outlet opening is in flow communication with the lower zone of the interior chamber and wherein an area of the at least one outlet opening is adjustable;

(d) gas supply means for supplying a fluidizing gas to the lower zone of the interior chamber;

(e) an outlet conduit in flow communication with the at least one outlet opening for receiving said feed material discharged from the interior chamber;

(f) at least one sensor to obtain measurements of a quantity of said particulate feed material inside the interior chamber; and (g) a means for controlling, responsive to the measurements, a discharge rate of the particulate feed material from the interior chamber through adjustments to the area of the at least one outlet opening.

2. The feed charging device of claim 1, further comprising a bottom partition having a plurality of apertures, wherein the gas supply means comprises a gas distribution chamber which is separated from the interior chamber of the holding vessel by said bottom partition, wherein the gas distribution chamber has an inlet for receiving said fluidizing gas, and wherein an interior of the gas distribution chamber is in flow communication with the interior chamber of the holding vessel through the plurality of apertures in the bottom partition.

3. The feed charging device of claim 2, wherein the gas distribution chamber is enclosed within a windbox, and wherein the bottom partition forms a top wall of the windbox.

4. The feed charging device of claim 2, wherein the gas distribution chamber comprises a plurality of compartments, each of said compartments being in flow communication with a portion of the interior chamber of the holding vessel through a subset of the plurality of apertures in the bottom partition.

5. The feed charging device of claim 1, further comprising a baffle plate located inside the interior chamber in close proximity to the at least one inlet opening, wherein the baffle plate is mounted to a bottom partition to permit pneumatic elevation of the particulate feed material from bottom to top.

6. The feed charging device of claim 2, wherein the gas supply means is selected from the group consisting of tuyeres, porous pads and porous membranes.

7. The feed charging device of claim 6, wherein the gas supply means comprises a plurality of said tuyeres which are received in said bottom partition in spaced relation to one another, and wherein the apertures are defined by said tuyeres.

8. The feed charging device of claim 6, wherein the bottom partition comprises one or more of said porous pads or porous membranes, and wherein the apertures are defined by said porous pads or porous membranes.

9. The feed charging device of claim 1, wherein the lower zone of the holding vessel defines an area to be occupied by a fluidized bed of said particulate feed material, and wherein the interior chamber also includes an upper zone which comprises a gas space above said fluidized bed;

wherein the at least one inlet opening is provided in the lower zone of the interior chamber, and is located below a bed level of the fluidized bed to allow introduction of the particulate feed material into the fluidized bed below the bed level.

10. The feed charging device of claim 1, further comprising at least one off-gas outlet opening provided in the interior chamber of the holding vessel, in communication with the upper zone of the interior chamber; and further comprising at least one deflector plate, at least a portion of which is located in the upper zone of the interior chamber, between the at least one inlet opening of the holding vessel and the at least one off-gas outlet opening.

11. The feed charging device of claim 10, wherein the at least one deflector plate is oriented substantially vertically and has a lower end which extends into the lower zone.

12. The feed charging device of claim 10, wherein the at least one deflector plate is oriented substantially vertically and has a lower end which is spaced above the lower zone.

13. A feed charging device comprising:

(a) a holding vessel having an interior chamber for holding a reserve of a solid particulate feed material in a fluidized state, wherein the feed material is held in said fluidized state in a lower zone of the interior chamber that defines an area to be occupied by a fluidized bed of said particulate feed material and wherein gas space above said fluidized bed defines an upper zone of the interior chamber;

(b) at least one inlet opening through which the feed material is supplied to the interior chamber;

(c) at least one outlet opening through which the feed material is discharged from the interior chamber, wherein said at least one outlet opening is in flow communication with the lower zone of the interior chamber;

(d) gas supply means for supplying a fluidizing gas to the lower zone of the interior chamber;

(e) an outlet conduit in flow communication with the at least one outlet opening for receiving said feed material discharged from the interior chamber, the outlet conduit having a conduit wall and the outlet conduit passing through the lower zone and the upper zone of the interior chamber; and (f) at least one off-gas outlet opening in the conduit wall of the outlet conduit, the at least one off-gas outlet opening in communication with the upper zone of the interior chamber.

14. A feed charging device comprising:

a holding vessel having an interior chamber for holding a reserve of a solid particulate feed material in a fluidized state, wherein the feed material is held in said fluidized state in a lower zone of the interior chamber;

at least one inlet opening through which the feed material is supplied to the interior chamber;

at least one outlet opening through which the feed material is discharged from the interior chamber, wherein said at least one adjustable outlet opening is in flow communication with the lower zone of the interior chamber and wherein an area of the at least one outlet opening is adjustable;

gas supply means for supplying a fluidizing gas to the lower zone of the interior chamber;

an outlet conduit having a conduit wall in which said at least one adjustable outlet opening is formed;

wherein the outlet conduit extends substantially vertically through said interior chamber, and wherein said gas supply means are radially dispersed around the outlet conduit.

15. The feed charging device of claim 14, wherein the at least one adjustable outlet opening is arranged to receive said feed material from a plurality of radial directions.

16. The feed charging device of claim 14, wherein the conduit wall of the outlet conduit has an outer perimeter, and wherein said at least one adjustable outlet opening is open to the lower zone of the interior chamber along substantially the entire outer perimeter of the conduit wall;

wherein the at least one adjustable outlet opening comprises a plurality of openings spaced apart along substantially the entire outer perimeter of the conduit wall; and wherein the at least one outlet adjustable opening comprises a horizontal slit extending throughout substantially the entire outer perimeter of the conduit wall.

17. The feed charging device of claim 14, wherein the at least one adjustable outlet opening is separated from a bottom of said interior chamber by a baffle ring having a height sufficient to prevent coarse particles within said particulate feed material from blocking said at least one outlet opening.

18. The feed charging device of claim 14, wherein the outlet conduit includes a slidable or rotatable cover member adapted to be moved steplessly or in discrete steps from a first position in which the area of the at least one adjustable outlet opening is at a maximum, to a second position in which the area of the at least one adjustable outlet opening is at a minimum;

the feed charging device further comprising an actuation mechanism for controlling the movement of the cover member between said first position and said second position.

19. The feed charging device of claim 18, wherein the at least one adjustable outlet opening comprises a horizontal slit extending throughout substantially the entire outer perimeter of the conduit wall, and wherein the cover member comprises a sleeve which is slidable longitudinally along a surface of the outlet conduit between said first position and said second position, and wherein the horizontal slit has a greater height with the sleeve in the first position than in the second position.

20. The feed charging device according to claim 1, further comprising a plurality of sensors to measure a pressure drop of the particulate feed material in the interior chamber of the holding vessel.

21. The feed charging device according to claim 1, further comprising:

multiple actuated valves mounted externally of the holding vessel;

a pressure sensor located in the lower zone; and an electronic feedback controller for controlling the valves, so as to:

control a volumetric flow rate of the fluidizing gas into the interior chamber; and maintain a required fluidization velocity using feedback from the pressure sensor, wherein the means for controlling is adapted to use the flow rate of the fluidizing gas when controlling the discharge rate of the particulate feed material.

22. A feed charging device comprising:

a holding vessel having an interior chamber for holding a reserve of a solid particulate feed material in a fluidized state, wherein the feed material is held in said fluidized state in a lower zone of the interior chamber;

at least one inlet opening through which the feed material is supplied to the interior chamber;

at least one adjustable outlet opening, provided in a side wall of the holding vessel, through which the feed material is discharged from the interior chamber, wherein said at least one adjustable outlet opening is in flow communication with the lower zone of the interior chamber;

gas supply means for supplying a fluidizing gas to the lower zone of the interior chamber;

an outlet conduit in flow communication with the at least one adjustable outlet opening for receiving said feed material discharged from the interior chamber;

wherein the side wall in which the at least one adjustable outlet opening is provided is distal to the at least one inlet opening.

23. The feed charging device of claim 22, wherein said at least one adjustable outlet opening is open to the lower zone of the interior chamber.

24. The feed charging device of claim 22, wherein the at least one adjustable outlet opening comprises one or more openings located along a base of the side wall;

wherein the at least one adjustable outlet opening comprises a horizontal slit extending along the base of the side wall.

25. The feed charging device of claim 22, wherein the at least one adjustable outlet opening is spaced from a bottom of said interior chamber by a height sufficient to prevent coarse particles within said particulate feed material from blocking said at least one adjustable outlet opening.

26. The feed charging device of claim 22, wherein the at least one adjustable outlet opening includes a slidable or rotatable cover member adapted to be moved steplessly or in discrete steps from a first position in which the area of the at least one adjustable outlet opening is at a maximum, to a second position in which the area of the at least one adjustable outlet opening is at a minimum;

the feed charging device further comprising an actuation mechanism for controlling the movement of the cover member between said first position and said second position.

27. The feed charging device of claim 26, wherein the at least one adjustable outlet opening comprises a horizontal slit, and wherein the cover member comprises a valve member which is rotatable between said first position and said second position, and wherein the horizontal slit has a greater height with the sleeve in the first position than in the second position.

28. The feed charging device of claim 1, wherein said means for controlling the area of the at least one adjustable outlet opening comprises a slidable or rotatable cover member adapted to be moved steplessly or in discrete steps from a first position in which the area of the at least one adjustable outlet opening is at a maximum, to a second position in which the area of the at least one adjustable outlet opening is at a minimum.

29. The feed charging device of claim 28, wherein said means for controlling the area of the at least one adjustable outlet opening further comprises an actuation mechanism for controlling the movement of the cover member between said first position and said second position.

30. The feed charging device of claim 1, wherein the feed charging device is for a flash smelting furnace including an elevated reaction shaft having a burner, and wherein the outlet conduit is attached to the upper end of the burner, above a reaction shaft where the particulate feed material is reacted with a reaction gas.

31. A method for improving the combustion performance of a flash smelting concentrate burner by improving the spatial and temporal uniformity of the feed entering the burner, the method comprising:

(a) providing a holding vessel having an interior chamber, the holding vessel having an interior chamber, at least one inlet opening and at least one outlet opening;

(b) feeding a solid particulate feed material into the interior chamber through said at least one inlet opening;

(c) fluidizing the feed material in a lower zone of the interior chamber by injecting a fluidizing gas into the lower zone of the chamber;

(d) discharging, to the burner, the fluidized feed material through the at least one outlet opening, wherein the at least one outlet opening is in flow communication with the lower zone of the interior chamber;

(e) measuring, directly or indirectly, a quantity of said particulate feed material inside the interior chamber; and (f) controlling an area of the at least one outlet opening in response to changes in the quantity of said particulate feed material inside the interior chamber.

32. A feed charging device comprising:

a holding vessel having an interior chamber for holding a reserve of a solid particulate feed material in a fluidized state, wherein the feed material is held in the fluidized state in a lower zone of the interior chamber;

an inlet opening through which the feed material is supplied to the interior chamber;

an outlet opening through which the feed material is discharged from the interior chamber, wherein the outlet opening is in flow communication with the lower zone of the interior chamber;

gas supply means for supplying a fluidizing gas to the lower zone of the interior chamber;

an outlet conduit in flow communication with the outlet opening for receiving the feed material discharged from the interior chamber a sensor to obtain measurements of pressure in the lower zone of the interior chamber; and a means of controlling, based on the measurements, a discharge rate of the particulate feed material from the interior chamber through adjustment of the flow rate of fluidizing gas.

* * * * *